US005107760A

United States Patent [19]

Pratt

[11] Patent Number: 5,107,760

[45] Date of Patent: Apr. 28, 1992

[54] MULTIPLE SCREEN SCREEN-PRINTING APPARATUS

[76] Inventor: Gordon D. Pratt, 305 W. Idaho St., Boise, Id. 83702

[21] Appl. No.: 628,160

[22] Filed: Dec. 17, 1990

[51] Int. Cl.[5] ..... B41F 15/02

[52] U.S. Cl. ..... 101/115; 101/126; 101/127.1

[58] Field of Search ..... 101/115, 123, 126, 127.1, 101/48

[56] References Cited

U.S. PATENT DOCUMENTS

| | | | |
|---|---|---|---|
| 2,206,176 | 7/1940 | Foard | 101/126 |
| 2,610,577 | 9/1952 | Heintges | 101/115 |
| 4,195,567 | 4/1980 | Mitter | 101/115 |
| 4,809,604 | 3/1989 | Harpold | 101/126 |

FOREIGN PATENT DOCUMENTS

| | | | |
|---|---|---|---|
| 1096081 | 12/1967 | United Kingdom | 101/115 |

*Primary Examiner*—Edgar S. Burr

*Assistant Examiner*—Ren Yan

*Attorney, Agent, or Firm*—Frank J. Dykas; Craig M. Korfanta; Ken J. Pedersen

[57] ABSTRACT

A multiple screen screen-printing apparatus (10) is disclosed which is specifically design to print numbers on sports jerseys and the like. The apparatus has a rectangular frame (15) in which a screen printing carriage rack (35) is slidably mounted and movable in a vertical direction. A rack and pinion assembly cooperates between frame (15) and carriage rack (35) to selectively move the carriage up and down within the frame. Carriage rack (35) contains a plurality of printing screen cassettes (65) slidably mounted therein and disposed in a vertical array. Cassettes (65) are slidable, in a drawer-like fashion, between an extended printing position and a retracted storage position. An angular printing platen (130) is pivotally mounted on a front face of frame (15). Platen (130) is pivotal between a right printing position, which aligns with the numerals on the right side of the center plane, and a left printing position, which aligns with the numerals on the left side of the center plane.

1 Claim, 9 Drawing Sheets

MULTIPLE SCREEN SCREEN-PRINTING APPARATUS

BACKGROUND OF THE INVENTION

1. Technical Field

This invention generally relates to screen printing apparatus, commonly known as silk screening printers, and more particularly, this invention relates to a multiple screen printing device for the printing of numbers on sports jerseys and the like or multicolor or several multicolor designs for long term periodic use.

2. Background Art

One of the more common and most versatile of the printing processes is that of screen printing, or more commonly known as silk screen printing. Screen printing can be used to print on paper products, wood, plastics, textiles, etc. The instant invention is concerned with industrial use of screen printing for the printing of designs on textiles used in clothing, home decorating and the like. Because of the extreme versatility associated with the screen printing process, screen printing is the method of choice for a wide variety of mediums. Also, the screen printing process is well suited for printing designs on textile articles after they have been assembled, e.g., shirts, uniforms, hats and the like. This is the primary concern of the instant invention. Particularly, the instant invention is concerned with the printing of numbers and multicolor designs on sports jerseys, etc.

Printing numbers on sports jerseys, pants and the like is somewhat of a specialized process since it is relatively labor intensive. This is because a separate screen is required for each digit of the number. For complicated numeral designs which require multiple screens for each digit, such as multiple colors, borders, etc., the process can be too costly to be profitable due to the shear number of screens and the labor involved. One can easily calculate the amount of time necessary to print a different two digit number on each of thirty or more jerseys.

To accommodate printing applications which require multiple screens, prior artisans developed the rotary printing press which has a plurality of printing screens, typically four or six, secured to a rotating carriage. The desired screen is rotated into position above the printing platen and the jersey is manually aligned on the platen to insure proper registration of each digit. FUCHS, U.S. Pat. No. 4,084,504, teaches one such rotary press which incorporates an unusually large number of printing screens secured to a plurality of rotary carriages and further incorporates multiple printing platens to accomplish number printing. The apparatus is necessarily large and complex.

HARPOLD, U.S. Pat. No. 4,809,604, takes the rotary printing concept one step further by adding an adjustable, movable platen assembly which includes a sophisticated registration system for use with large screens having a multiplicity of numbers thereon. The printing platen is angular in shape to provide dual printing surfaces and is mounted on a reciprocating carriage for positioning under any one of a plurality of masks, arranged linearly on a printing screen. To be effective, the apparatus needs to use oversize screens in order to hold the multiplicity of designs or masks.

Obviously these machines, as well as all the other numeral printing setups of which the inventor is aware, are quite large, complex and expensive.

What is needed is compact, efficient and relatively inexpensive numeral screen printing apparatus which uses standard sized screens and yet provides sufficient flexibility to accommodate complex printing jobs. It is therefor an object of the present invention to fulfill these needs. It is a further object of the present invention to provide a relatively simple screen printing press for the printing of multiple digit numerals which is durable and easily maintained.

DISCLOSURE OF INVENTION

These and other objects are accomplished by a screen printing apparatus which has a rectangular frame in which a screen printing carriage rack is slidably mounted and movable in a vertical direction. A rack and pinion assembly cooperates between the frame and the screen printing carriage rack to selectively move the carriage up and down within the frame. A suitable locking mechanism, such as a spring biased pawl, is employed to prevent the carriage from undesirably advancing downward due to the force of gravity. The carriage rack contains a plurality of printing screen cassettes, generally ten such cassettes, slidably mounted therein and disposed in a vertical array. The cassettes are slidable, in a drawer-like fashion, between an extended printing position and a retracted storage position. Each cassette is removably fitted, with a standard sized printing generally having a pair of like numerals centered about and separated by a common centerline, with each screen in the vertical array being so positioned such that their individual centerlines define a common center plane. Normally, each screen contains a different pair of numerals from the set, 00, 11, 22 ... 99.

An angular printing platen is pivotally mounted on a front face of the rectangular frame. The platen generally has two printing faces separated by a obtuse angle and meeting at a centerline which also lies in the center plane. The platen is pivotal between a right printing position, which aligns with the numerals on the right side of the center plane, and a left printing position, which aligns with the numerals on the left side of the center plane.

To print the number "9", for instance, on an article, the printer would advance the carriage within the frame until the screen cassette carrying the numeral "1" on the right side of the center plane, since the numbers are usually printed upside down with respect to the user, to a vertical position where the screen lies in a horizontal plane immediately above the printing platen. The carriage is then locked into this position. The cassette is then extended into its printing position and the design is printing on the article using a standard printed technique. Then the platen is pivoted into its left printing position and the screen cassette is retracted into its storage position. The carriage is then unlocked and advanced up or down until the screen containing the numeral "9" on the left side of the center plane is positioned in the horizontal plane immediately above the printing platen and the carriage is locked into place. The screen is then extended into its printing position and the printing is completed.

BEST MODE FOR CARRYING OUT INVENTION

Figure 1:
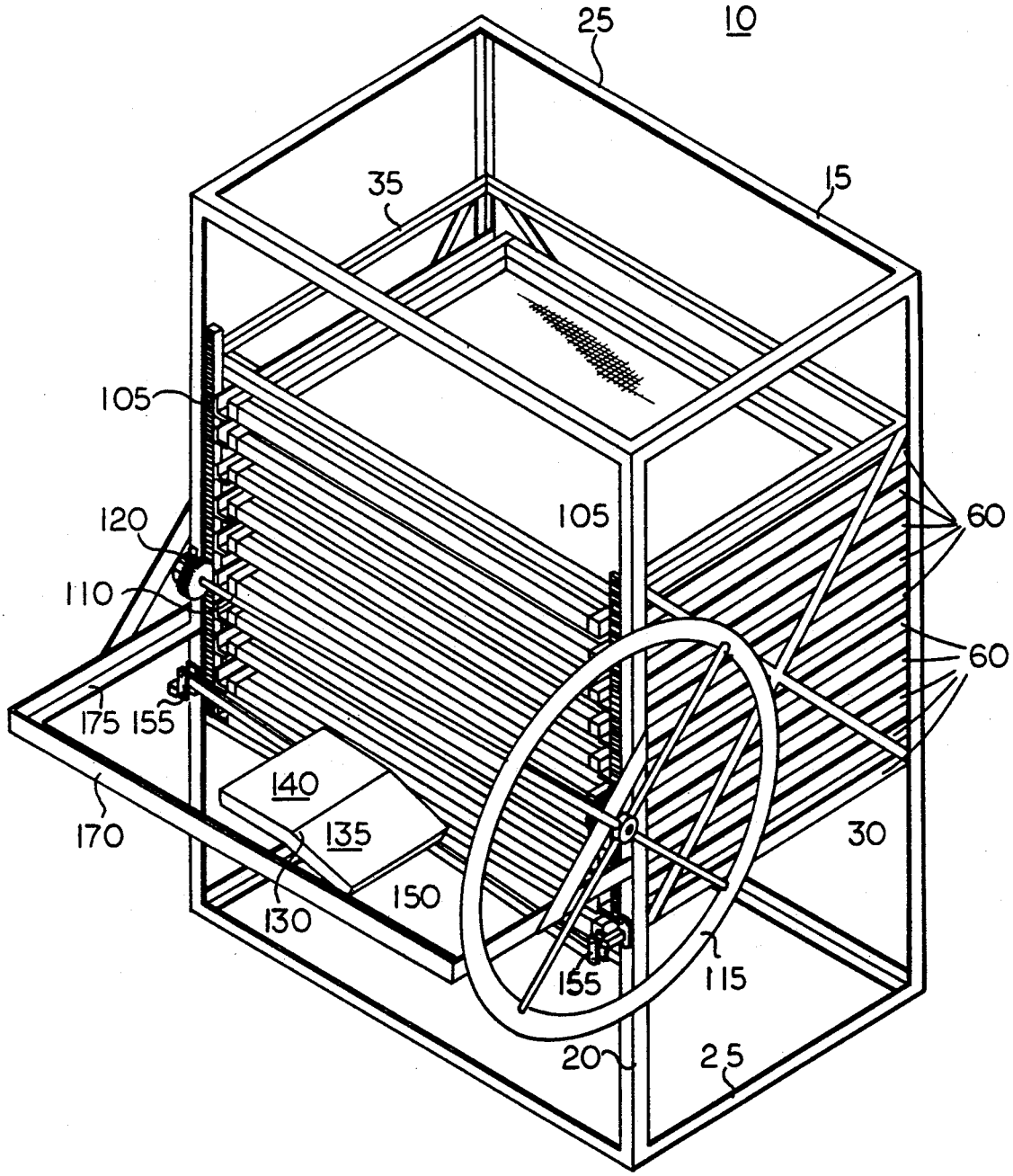
FIG. 1 is a three-quarter elevation view of the multiple screen screen-printing apparatus.
Figure 2:
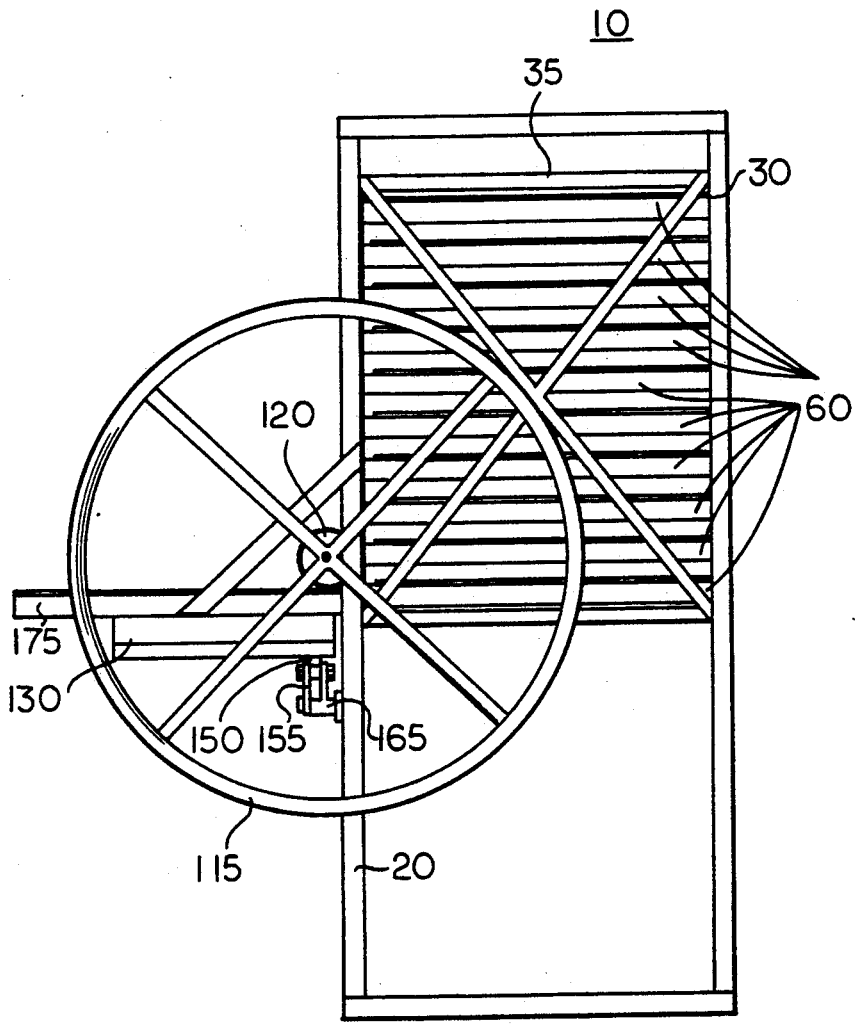
FIG. 2 is a right side view of the multiple screen screen-printing apparatus.
Figure 3:
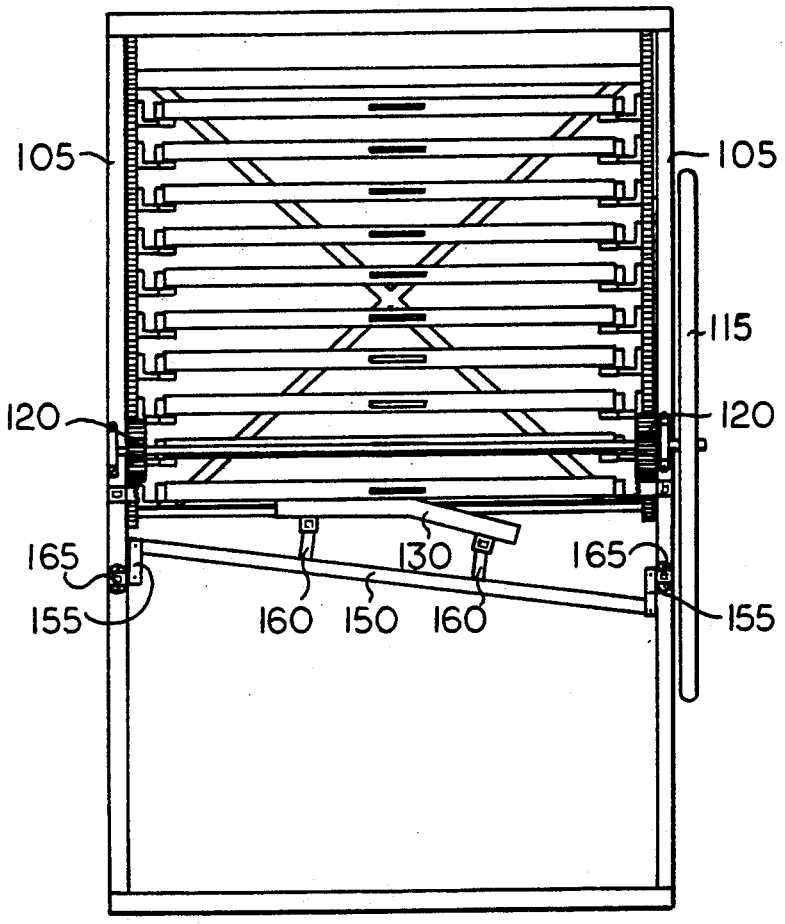
FIG. 3 is a front view of the multiple screen screen-printing apparatus with the support shelf removed for the sake of illustration.
Figure 4:
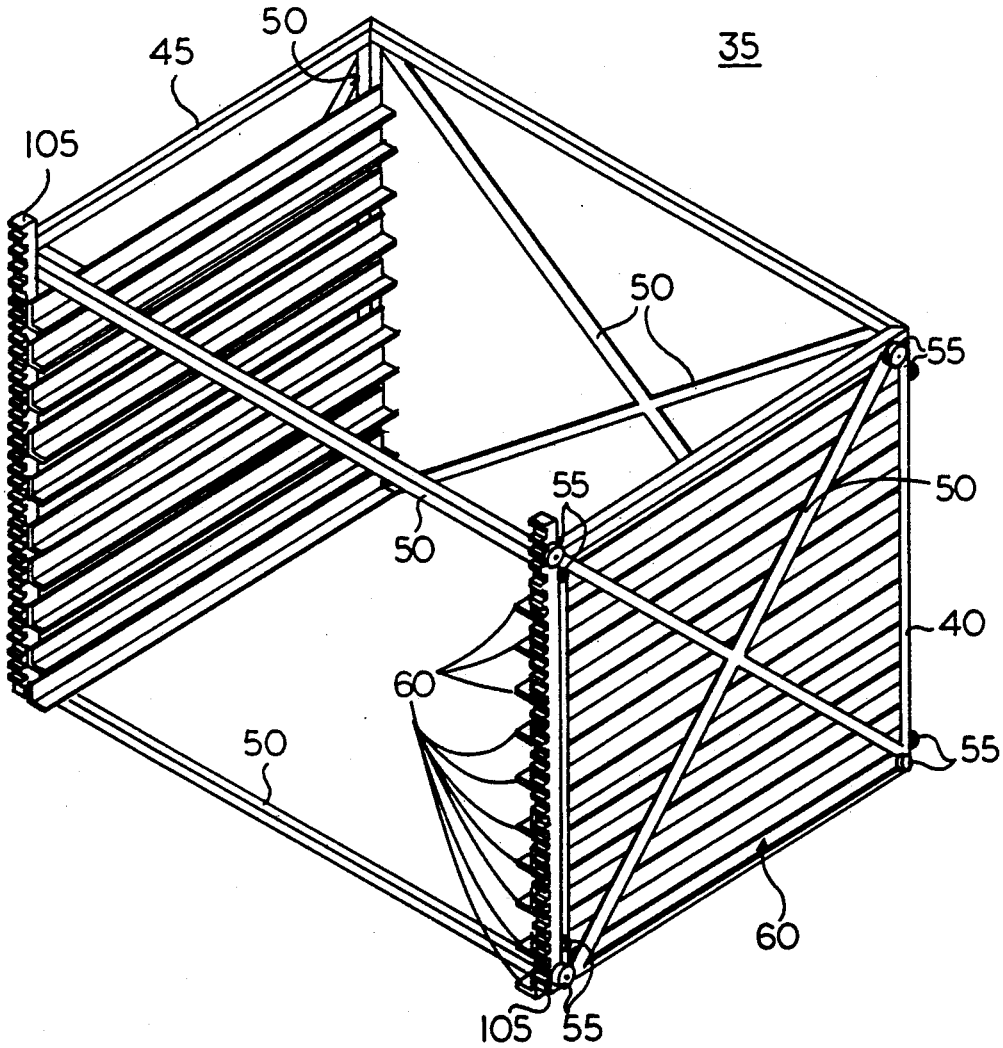
FIG. 4 is a three-quarter elevation view of the printing screen carriage rack.
Figure 5A:
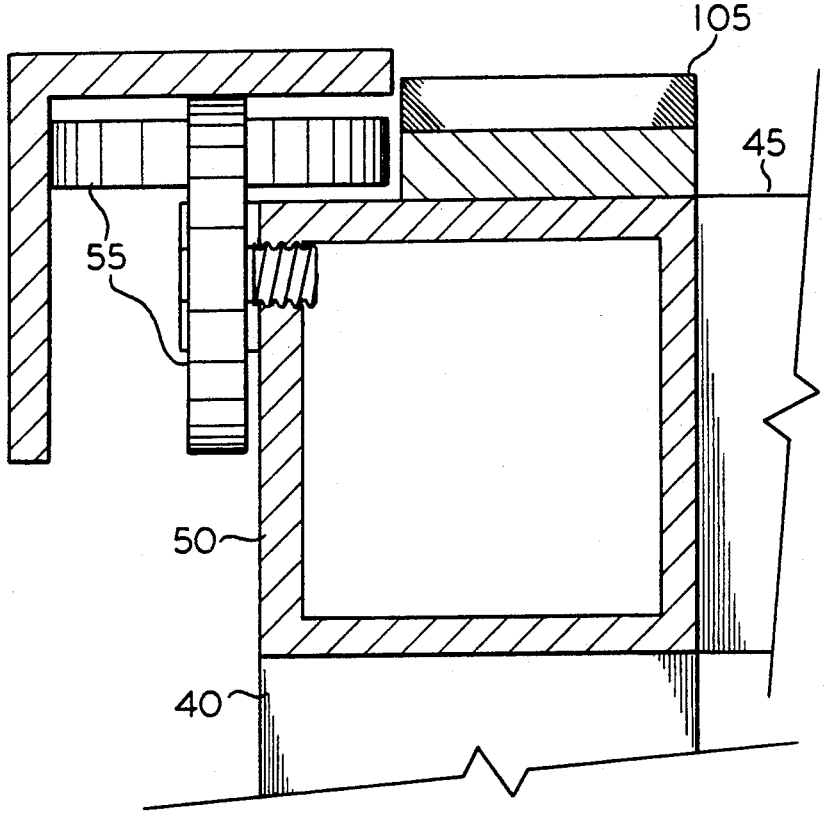
FIG. 5*a* is a top end detail view of a front rack side member showing the bearing wheel and rack gear attachment configuration.
Figure 5B:
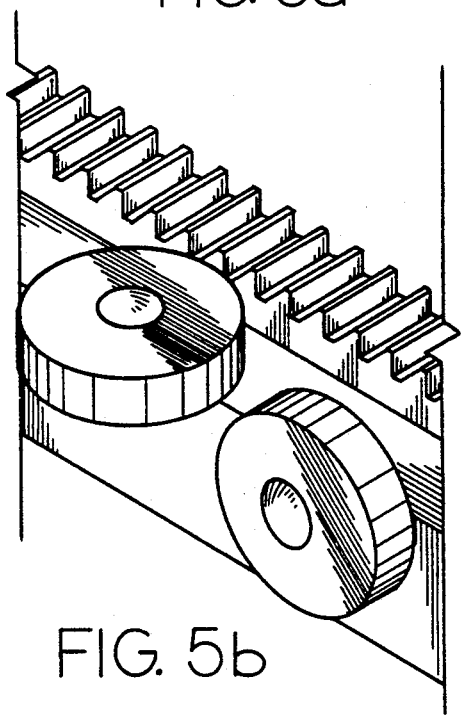
FIG. 5*b* is a perspective view in exploded cross section of a front rack side member showing the bearing wheel and rack gear attachment configuration.
Figure 6:
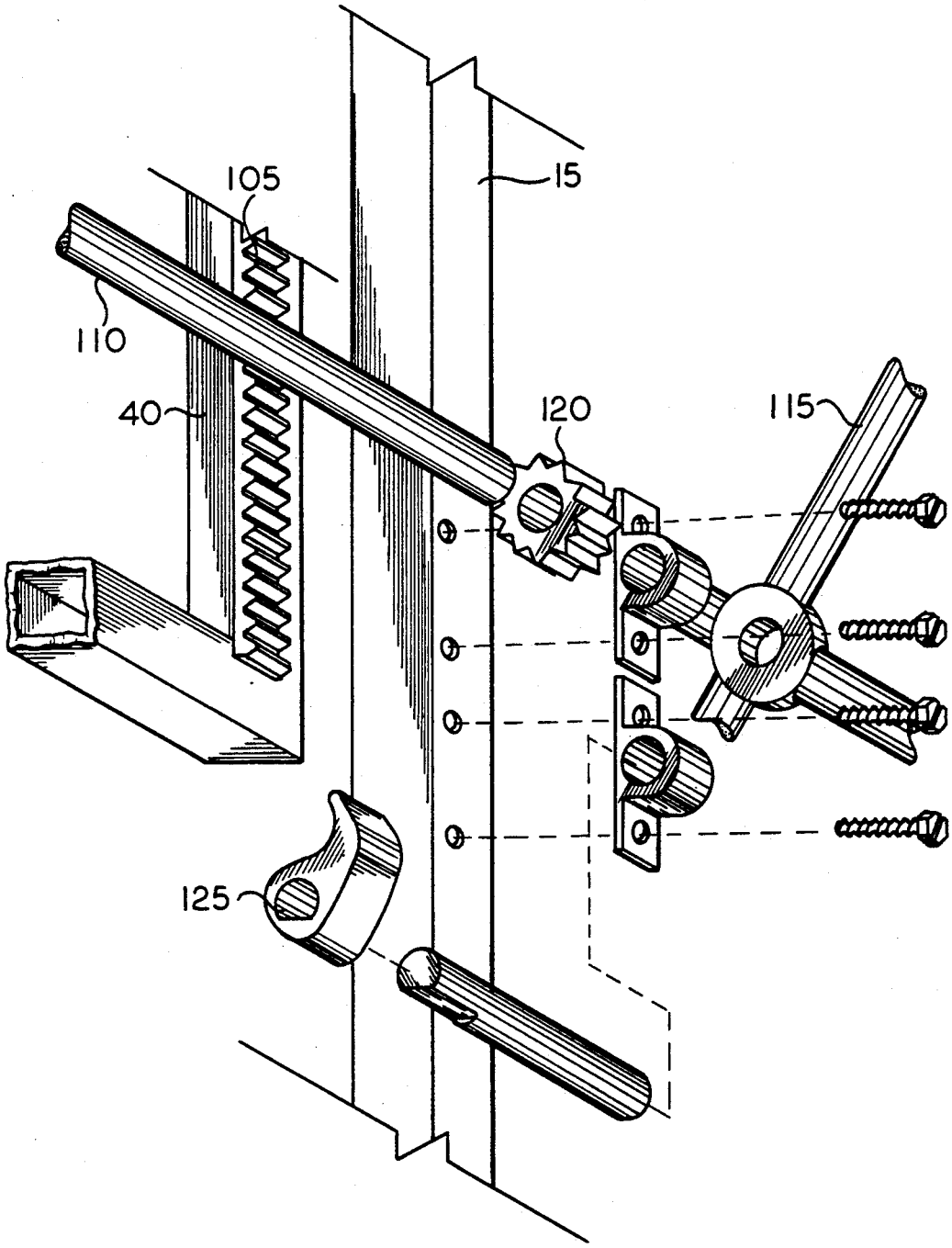
FIG. 6 is a perspective view in exploded cross section of the right rack and pinion and locking pawl assembly.
Figure 7:
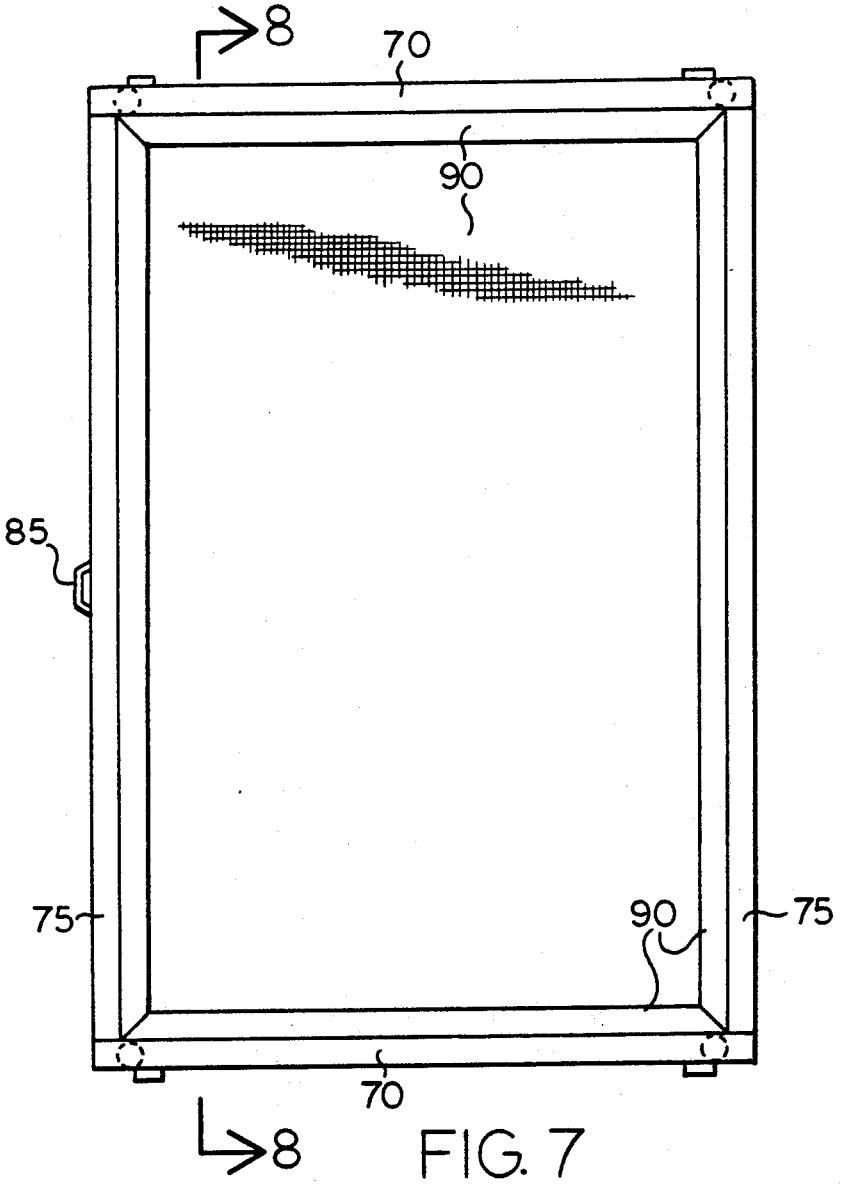
FIG. 7 is a bottom plan view of a printing screen and screen cassette.
Figure 8:
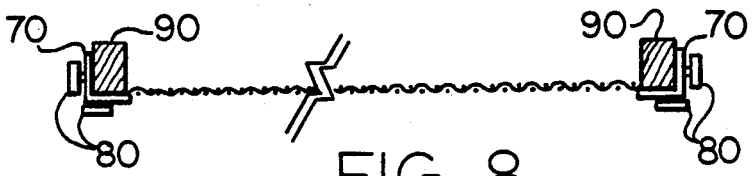
FIG. 8 is a front side sectional view of the printing screen and screen cassette of FIG. 7, taken along section line 8 of FIG. 7.
Figure 9:
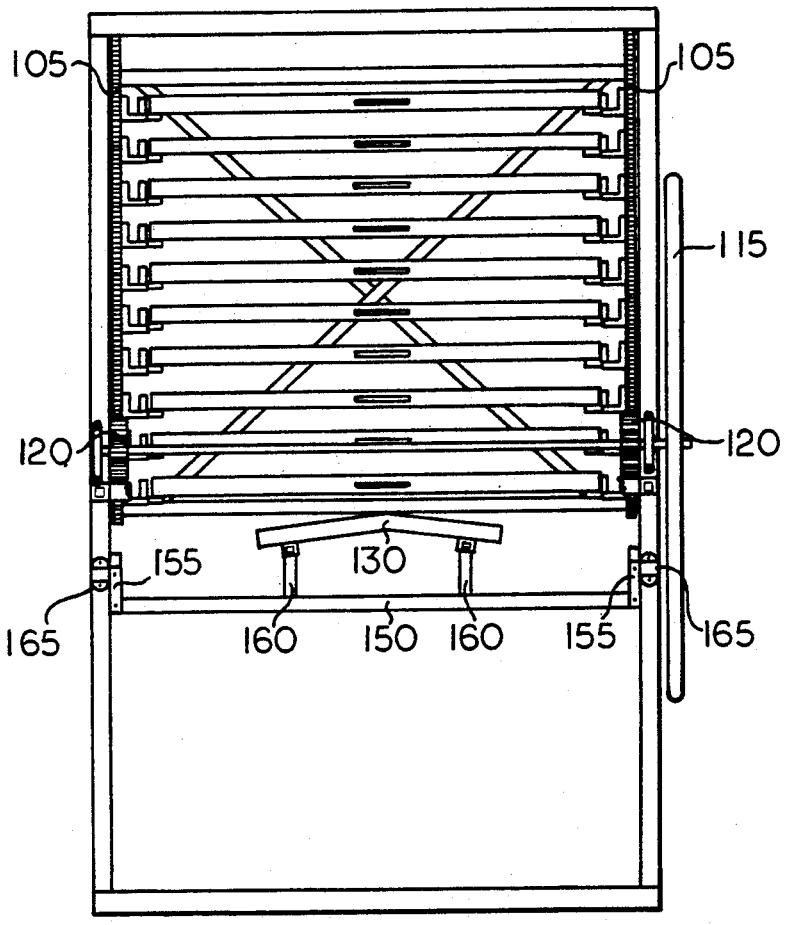
FIG. 9 is a front view of the multiple screen screen-printing apparatus, with the support shelf removed for the sake of illustration, showing the platen assembly in a release position.
Figure 10:
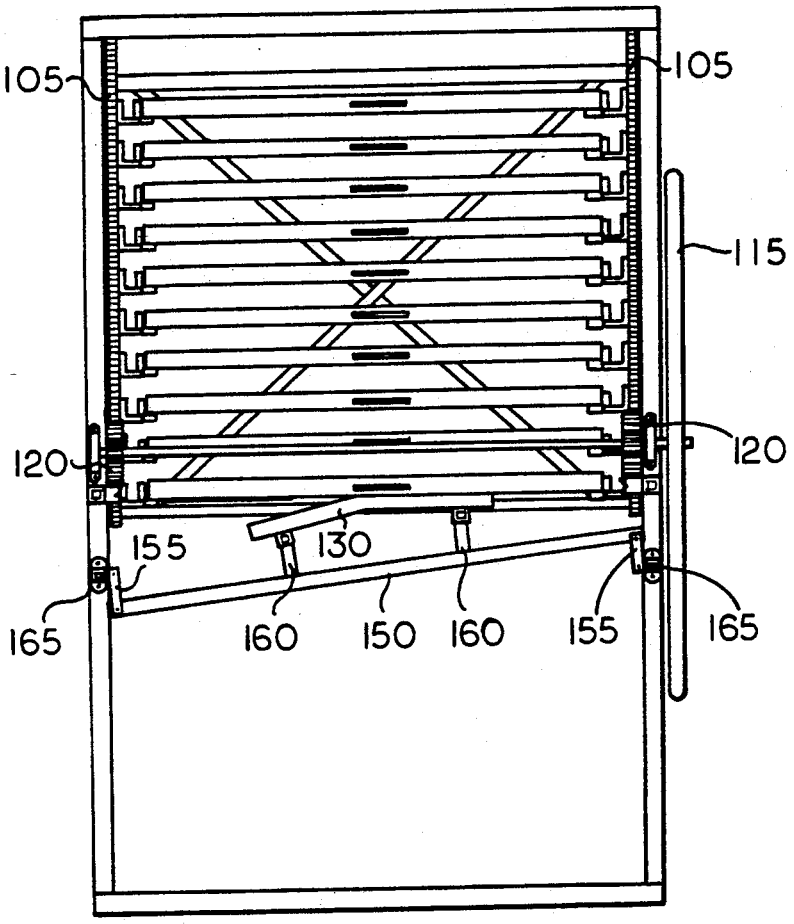
FIG. 10 is a front view of the multiple screen screen-printing apparatus, with the support shelf removed for the sake of illustration, showing the platen in right side printing position.

Referring now to FIGS. 1 through 10 a preferred embodiment of the multiple screen screen-printing apparatus 10 is illustrated. Multiple screen screen-printing apparatus !0 has a base frame structure 15 manufactured in a rectangular configuration and is here made from welded angle iron or aluminum. Four side members 20 are vertically positioned and secured together via eight end members 25. Six cross support members 30 are attached in pairs in an "X" configuration to each of the right side face, the left side face and the rear face to provide rigidity to frame structure 15.

A printing screen carriage rack 35 is similarly constructed from angle iron or aluminum and is sized to be slidably received within frame structure 15. Printing screen carriage rack 35 includes four rack side members 40 fixed in vertical parallel spaced relation by rack end members 45. Each of the rack members 40 has a set of four bearing wheels 55 attached thereto to reduce friction between carriage rack 35 and frame structure 15. Bearing wheels 55 are advantageously attached to rack side members 40 in the general configuration shown in FIGS. 4 and 5.

Opposing pairs of parallel printing screen cassette supports 60 are attached to the inside surfaces of rack side members 40 in horizontal planes to form a vertical array of guides to receive printing screen cassettes 65. Printing screen cassette supports are here manufactured from lengths of angle iron or aluminum. Printing screen cassettes 65 are likewise constructed from angle iron or aluminum and here consist of a rectangular frame, lying in a coordinate plane, and have a pair of cassette side members 70 fixed in parallel spaced relation by cassette end members 75.

A pair of bearing wheels 80 are attached to each side of each cassette side member 70 and are disposed to engage cassette supports 60 to permit printing screen cassettes 65 to extend and retract between printing and storage positions. Likewise, a pair of spring loaded bearing wheel assemblies 80 are attached to the underside of each cassette side member 70. Bearing wheel assemblies 80 act to align cassettes 65 within carriage rack 35 to center each printing screen 90 about the center plane. Suitable stops can be added to prevent cassettes 65 from unintentionally altogether disengaging cassette supports 60, if desired. Cassette handles 85 are attached to each cassette at its front end member 75 to facilitate extending and retracting the cassettes.

In this preferred embodiment, ten printing screens 90, each carry a pair of like digits defined by printing masks. Each printing mask is centered about a centerline which bisects the two like numerals in the mask. Each mask is different from the other in that it defines a pair of numerals selected from the set of the following numbers: "00", "11", "22", "33", "44", "55", "66", "77", "88" and "99". Screens 90 are each positioned within there respective cassettes 65 such that their centerlines define a common center plane.

In a like manner multiple screen printing press 10 could be set up to hold screens 90 for use with periodic multicolor applications such as printed sweatshirts for clubs and fraternities, wherein made-to-order limited production runs are regularly made every few months and it is desirable to leave screens 90 in cassettes 65 rather than removing them to long term storage.

A carriage translation assembly is provided to advance the cassette carriage rack 35 up and down within frame structure 15. The carriage translation assembly here consists of a pair of cooperating rack and pinion gear sets, where the rack gears are designated at 105 and the pinion gears are designated at !20. Rack gears 105 are attached along the length of front rack side members 40 while pinion gears are radially attached to pinion axle 110 and positioned to meshedly engage rack gears 105. Pinion axle 110 is rotatably attached across the front face of frame structure 15, secured by a suitable bearing, such as standard pillow blocks. One end of pinion axle 110 extends beyond one of the side faces of frame structure 15 and has a handwheel 115 radially attached thereto to facilitate raising and lowering carriage rack 35. A spring biased locking pawl 125 is pivotally attached, via a pillow block or the like, to frame structure 15 and engages one of the pinion gears to prevent unintentional movement of carriage 35.

An angular printing platen 130 is pivotally attached across the front face of frame structure 15 and is carried by a movable support assembly. Printing platen 130 has a pair of printing faces, right printing surface 135 and left printing surface 140. The printing faces are separated by an obtuse angle and intersect at a vertex which lies in the common plane. Printing platen 130 is supported on movable platen support bar 150 by a pair of platen support members 160. Platen support bar 150 is pivotally attached at each end to a pivot bracket 155, which are each in turn pivotally attached to an L shaped pivot bracket support 165. L shaped pivot bracket supports 165 are fixed to-front side members 20. Pivot brackets 155 here consist of a saddle or double strap type bracket. This configuration for the platen support actually provides positions for the platen: a left side printing position having platen support bar 150 disposed at a negative slope; a right side printing position having platen support bar 150 disposed at a positive slope; and a neutral position having platen support bar 150 disposed at a zero slope and platen 130 out of close proximity of the horizontal printing plane.

A printing screen support shelf 170 is here attached to the front face of frame structure 15 and extends perpendicularly out therefrom in the horizontal printing plane.

Screen support shelf 170 acts to support screen cassettes 65 when they are in their extended positions and the sides of the shelf serve as screen registration guides 175.

It should be apparent that certain modifications can be made without departing from the spirit of the invention. These modifications include, but are not limited to, modifying the rectangular configuration to accommodate various shapes of screens and providing a power assist to the carriage translation assembly such as an electric, pneumatic or hydraulic drive or lift.

While there is shown and described the present preferred embodiment of the invention, it is to be distinctly understood that this invention is not limited thereto but may be variously embodied to practice within the scope of the following claims.

I claim:

1. A multiple screen screen-printing apparatus which comprises:

a frame structure with front and back side members and end members, said frame being sized and configured to slidably receive a carriage rack of printing screens, the frame having a front face;

a printing screen carriage rack being in slidable engagement within said frame structure, the carriage rack having ten pairs of parallel printing screen supports being attached thereto and disposed to position printing screens in a parallel array of substantially horizontal planes;

a set of ten printing screens, each being slidably engaged in said pairs of printing screen supports between a first position having each screen disposed within the confined carriage rack and a second position having the screen extended forward of the carriage into a printing position;

each of the printing screens having a distinct printing mask thereon consisting of a pair of numerical digits symmetrically disposed about a bisecting centerline, one digit being the duplicate of the other, wherein a first screen contains a print mask of the number 00, a second screen contains a print mask of the number 11, a third screen contains a print mask of the number 22 and so on up to a tenth screen containing a print mask of the number 99;

carriage translation means being cooperatively engaged between the carriage rack and the frame structure for positioning the carriage rack within the frame structure;

a printing platen being pivotally attached across the front face of the frame structure and disposed to print in a substantially horizontal plane, said platen being made pivotal by a movable support assembly consisting essentially of a pair of platen support members supporting the platen on a movable platen support bar, the support bar being pivotally attached at each end to a pivot bracket, the pivot brackets in turn each being pivotally attached to an L-shaped pivot bracket support fixed to one of said front side members member of said frame structure;

the print platen having two printing faces disposed side by side and in an obtuse angular orientation one to the other and being rotatable between a first printing position where a first printing face is disposed in a horizontal printing position for printing of a first digit of a two digit number, and a second printing position where a second printing face is disposed in a horizontal printing position for printing of a second digit of the two digit number;

a printing screen support means comprising a shelf extending perpendicularly out from the front face of the frame structure and lying in a horizontal plane immediately above the printing platen, said shelf being attached to the front face of the frame structure and being configured to slidably receive, in a drawerlike fashion, and hold each of the plurality of printing screens in its second printing position and directly above the platen, in close spaced relation thereto, to permit printing of a design carried by the screen.

* * * * *